US006408744B1

(12) United States Patent
Viennet et al.

(10) Patent No.: US 6,408,744 B1
(45) Date of Patent: Jun. 25, 2002

(54) COMPACT INK-JET FRANKING MACHINE WITH MANUAL INSERTION

(75) Inventors: Franck Viennet, Paris; Jean-Louis Potey, Courbevoie, both of (FR)

(73) Assignee: Secap (FR)

( * ) Notice: Subject to any disclaimer, the term of this patent is extended or adjusted under 35 U.S.C. 154(b) by 0 days.

(21) Appl. No.: 09/530,142

(22) PCT Filed: Aug. 23, 1999

(86) PCT No.: PCT/FR99/02028

§ 371 (c)(1),
(2), (4) Date: Jun. 21, 2000

(87) PCT Pub. No.: WO00/16268

PCT Pub. Date: Mar. 23, 2000

(30) Foreign Application Priority Data

Sep. 14, 1998 (FR) ..... 98 11425

(51) Int. Cl.[7] ..... B41L 47/46
(52) U.S. Cl. ..... 101/91; 400/708
(58) Field of Search ..... 101/91, 232, 287; 400/708; 209/900

(56) References Cited

U.S. PATENT DOCUMENTS 4,882,989 A * 11/1989 Nobile ..... 101/235
5,640,903 A * 6/1997 Salomon ..... 101/91
5,889,535 A * 3/1999 Jackson et al. ..... 347/22

* cited by examiner

*Primary Examiner*—Ren Yan
(74) *Attorney, Agent, or Firm*—Michaelson & Wallace; Peter L. Michaelson

(57) ABSTRACT

This machine for postage metering a flat object (6) such as an envelope or a label comprises a horizontal opening for inserting an object, leading to two stops (8, 9) at right angles, a device for holding the object by gripping it between a fixed upper ceiling (2) comprising a window (2') and a lower plate (3) vertically movable by means of a drive mechanism, an ink jet printing device (1) whose nozzles are disposed inside the window (2') of said ceiling, and a sensor (10) of the presence of an object in the vicinity of the corner of the stops (8, 9), which starts the drive mechanism of the plate (3) for gripping the object (6) and the printing cycle. A motorized transverse rake (4) moves the object (6), while it is gripped, in front of the printing device (1).

10 Claims, 6 Drawing Sheets

COMPACT INK-JET FRANKING MACHINE WITH MANUAL INSERTION

BACKGROUND OF THE INVENTION

1. Field of the Invention

The present invention relates to a machine for affixing, by means of an ink jet printing device, a postage mark to a flat object such as an envelope or a label, and relates more precisely to a machine of this type with manual insertion.

2. Description of the Prior Art

In an automatic mail processing machine, envelopes are generally carried through the machine by a carrying device such as a conveyor belt, along a path that runs from an entry point to an exit point, passing through the printing station. This is not the case in an office machine with manual insertion, into which the user partially inserts the envelope through an insertion opening of the machine; the envelope receives the postage mark, after which the user manually withdraws the envelope.

There is a known machine for metering a flat object such as an envelope or a label, marketed under the name Personal Post Office by the Pitney Bowes company, of the following type: the machine comprises, in a frame, an opening for the manual insertion of an object leading to two stops at right angles, a device for holding an object by gripping it between a fixed upper ceiling comprising a window and a lower plate vertically movable by means of a drive mechanism, an ink jet printing device whose nozzles are disposed inside the window of said ceiling, and a sensor of the presence of an object in the vicinity of the corner of the stops, which starts the drive mechanism of the plate for gripping the object and the print cycle. The printing is done in a single pass of the print head (in a reference direction that will be described as longitudinal); in order to allow this single pass, the head is specific and has non-standard dimensions that allow it to transversely cover the entire area to be metered in one movement. However, the need for a special print head increases the cost of the machine.

In order to be able to use standard print heads, which generally cover ⅙ of an inch (4.23 mm) transversely, it is conceivable to use several heads disposed and coordinated so as to cover the entire metering area in one pass, or to make a print head movable in the transverse direction, i.e., perpendicular to the direction of the printing pass, in order to have it complete several staggered passes covering the printing area. Both of these solutions substantially complicate the production of the machine and add to its price.

SUMMARY OF THE INVENTION

The object of the invention is to eliminate these drawbacks and to offer a simple and compact machine that accommodates standard print heads.

This object is achieved according to the invention by a postage metering machine of the above-mentioned type, equipped with a device for transversely moving the object in front of the printing device, even while the object is gripped.

This transverse moving device, which has only a small range of travel to complete, is advantageously a horizontally movable rake whose teeth pass one of said stops (the longitudinal one) in order to transversely push the edge of a detected object.

The rake is advantageously driven by a motor, preferably through a screw-nut system.

This motor is preferably independent from the one with which the printer is equipped for the longitudinal movements of the print head. On the other hand, the vertical movement of the plate is advantageously executed in one direction by means of the same engine that drives the rake and in the opposite direction by means of antagonistic springs. Preferably, the springs act in the direction of the gripping of the object, and their force is calculated to be able to grip the document lightly without counteracting the transverse movement imparted by the rake.

Also advantageously, the movement of the plate is executed by means of the movement of the rake. For this reason, the plate and the rake are preferably linked by at least one flexible tie.

The machine of the invention operates in the following way. Initially, the plate being in the retracted position, the user inserts the object to be metered into the insertion opening as far as its stops, so that the top right corner of the object is detected by the sensor, which starts the next cycle. The motor of the rake turns on and drives both the forward movement of the rake, whose teeth are still behind the longitudinal stop, and the lifting of the plate by the springs, until the object is gripped, then pressed against the reference ceiling. The plate comes to a stop while the rake continues to move forward and pushes the object with its teeth, which pass the longitudinal stop, in order to first correct the object's position if necessary, then, in successive steps coordinated with the printing passes, to have it receive the postage mark. Once the printing is finished, the motor of the rake runs in the opposite direction so that the rake is drawn backward and drives the descent of the plate, thereby releasing the envelope, which can be removed by the user.

The machine of the invention therefore allows non-contact ink jet printing onto media of variable thicknesses and dimensions, with the following guarantees:

- the top side of the flat object is always kept at a constant distance from the ejection nozzles during printing,
- the holding device makes it possible to process objects having variable thicknesses,
- the moving device makes it possible to process objects of variable dimensions, the same machine processing both small labels or envelopes as well as large envelopes,
- the moving device does not cause any folding of the outer surfaces of the objects during the movement so as not to diminish the print quality, thanks to a recess in the ceiling facing the window provided in the plate,
- the device makes it possible to print a postage mark in a precise area of the article processed.

Other characteristics and advantages of the present invention will emerge from the following description of an exemplary embodiment of the invention illustrated by an application to the metering of an envelope and referring to the attached drawings in which:

DETAILED DESCRIPTION

Figure 1:
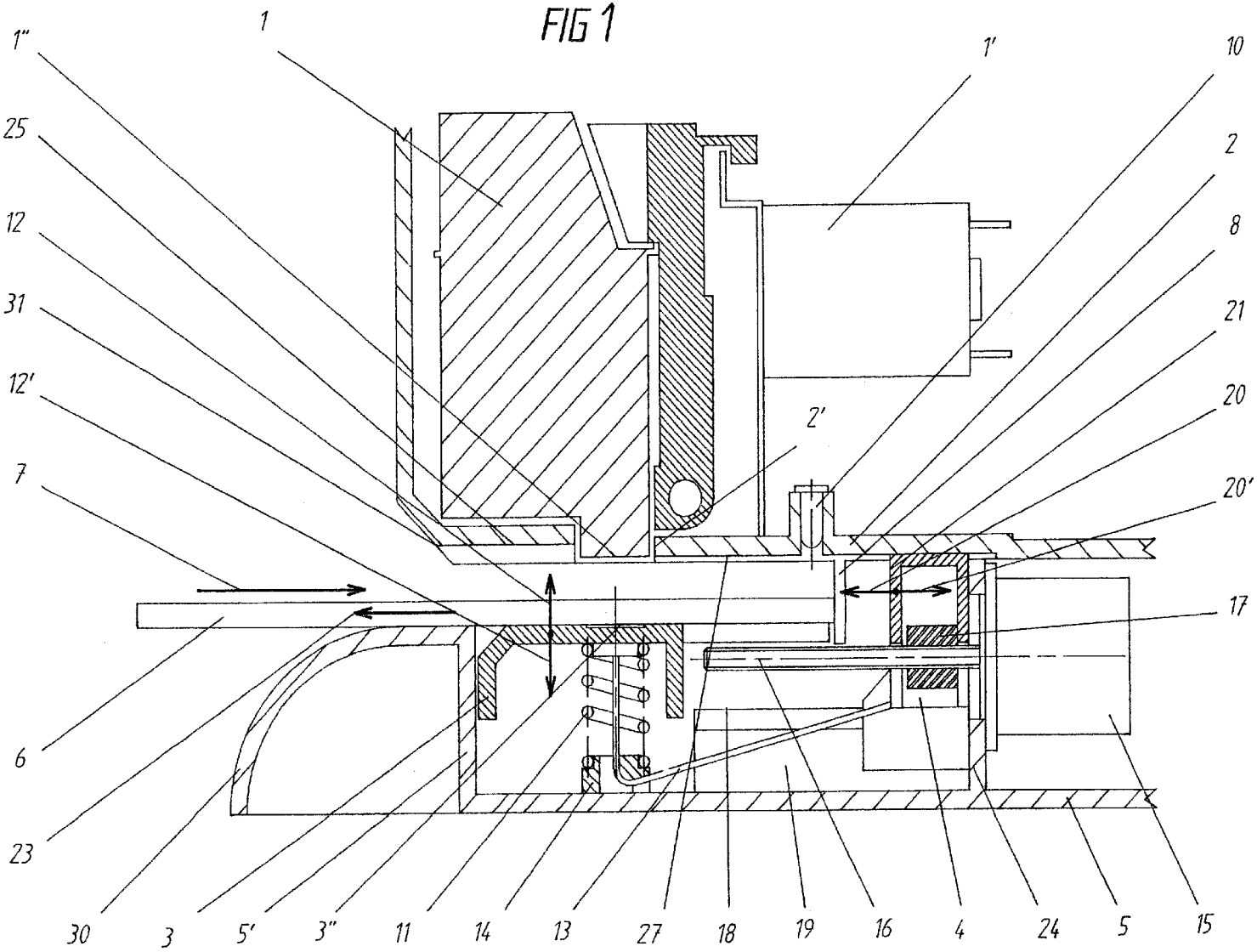
FIG. 1 is a sectional side view of the device of the invention in the initial position, specifically showing the printing device and the system for moving an object according to the invention.
Figure 4:
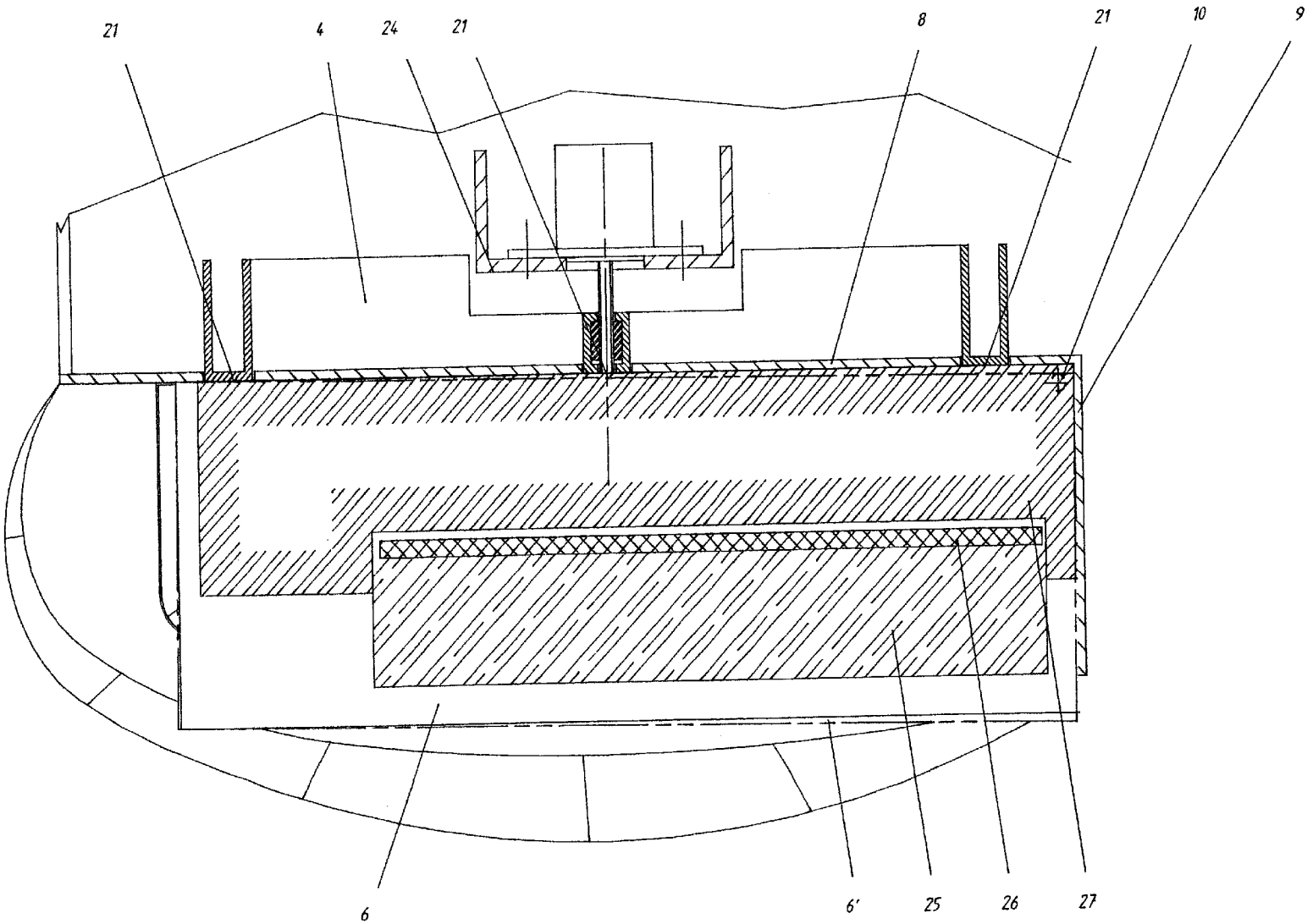
FIG. 4 is a simplified illustration similar to FIG. 2, showing the various mechanisms at the end of the first movement cycle, and in which the projections of the printing area, the area that is pressed against the ceiling and the recess in the ceiling.

The metering machine comprises, in a frame specifically constituted by a lower body 5, a standard ink jet head 1 associated with its drive motor 1' so as to be horizontally movable longitudinally (directions 22, 22') and having its nozzles 1" disposed vertically near the bottom in order to define, during the movement of the head, a printing area 26 (cf. FIG. 4). The printing area 26 is surrounded by a rectangular window 2' formed in a fixed horizontal upper ceiling 2 integral with the frame, defining at least behind and possibly on the sides of said window 2' an upper reference surface 27 (cf. FIGS. 1 and 4) against which the envelope will be pressed. On the other hand, the ceiling 2 forms at the front of the window 2' a recess 25 (cf. FIGS. 1 and 4), near the top for reasons given below. The nozzles 1" overhang and face a part 3", which may be slightly recessed (essentially corresponding to the printing area 26), of a longitudinally elongated lower plate 3, vertically movable by means of a drive mechanism that will be described below. A horizontally movable longitudinal rake 4 is disposed behind the printing area, parallel to the plate 3, for pushing an envelope 6 that has been manually inserted into the machine in the oblique direction 7, through a horizontal opening of the machine forming two sides of a rectangle whose other two sides are embodied by longitudinal rear 8 and transverse lateral 9 stop and support surfaces belonging, for example, to the upper ceiling 2, and against which the inserted object 6 can be referenced. The insertion of the envelope 6 is facilitated by splaying the edge of the opening formed by rounded areas 30 of the lower body and by bevelled comers 31 of the upper ceiling 2.

The envelope 6 is oriented and positioned in the following way:

- the surface onto which the postage mark will be printed is on top so that it faces the upper ceiling 2,
- the top edge of the envelope 6 is in contact with the longitudinal support surface 9.

The detection of the placement of the envelope 6 against the references is ensured by an optical barrier 10 (optical cell) integral with the upper ceiling 2, placed in the area of the intersection of the support surfaces 8 and 9. Thus, any incorrect positioning of the envelope will prevent the envelope 6 from being detected.

The lower plate 3 is an elongated rectangular plate, mounted so as to be vertically movable in the vertical directions 12 and 12' in the lower body 5, by means of vertical walls 6' of the body and the surface 9 that cooperate with a vertical shoulder 3' extending from the plate 3, preferably forming a bevelled corner. Helical springs 11 compressed between the lower body 5 and the lower plate 3 continuously place upward stress on the latter, in the direction 12'. Flexible ties 13 (for example wires, cables or flexible strips), attached at one of their ends underneath the lower plate 3 descend through the inside of the springs 11, pass through the bases 14 of the springs 11, and are attached at their other end to the movable rake 4 so that the backward movement of the rake 4 (in the direction 20') drives the lowering of the plate 3 and its retraction into the body 5.

The movable rake 4 is motorized by a motor 15 by means of a screw-nut system. The screw 16 is integral with the rotor of the motor 15. The nut 17 is integral with the movable rake 4. The movable rake 4 is guided by slides or vertical surfaces 18, 19 of the lower body 5; it is movable in the transverse horizontal directions 20 and 20'.

The movable rake 4 comprises three vertical teeth 21 that come into contact with the top edge of the envelope 6 in order to push it. These teeth are positioned and sized so as to correctly push all standard envelope formats to be processed, as well as a label format. The rear surface 8 comprises openings 28 for the passage of the teeth 21, and the plate 3, comprises, at the rear, notches 29 in its bottom for their passage.

The print cycle is started after the detection of the corner of an envelope by the optical barrier 10.

Figure 2:
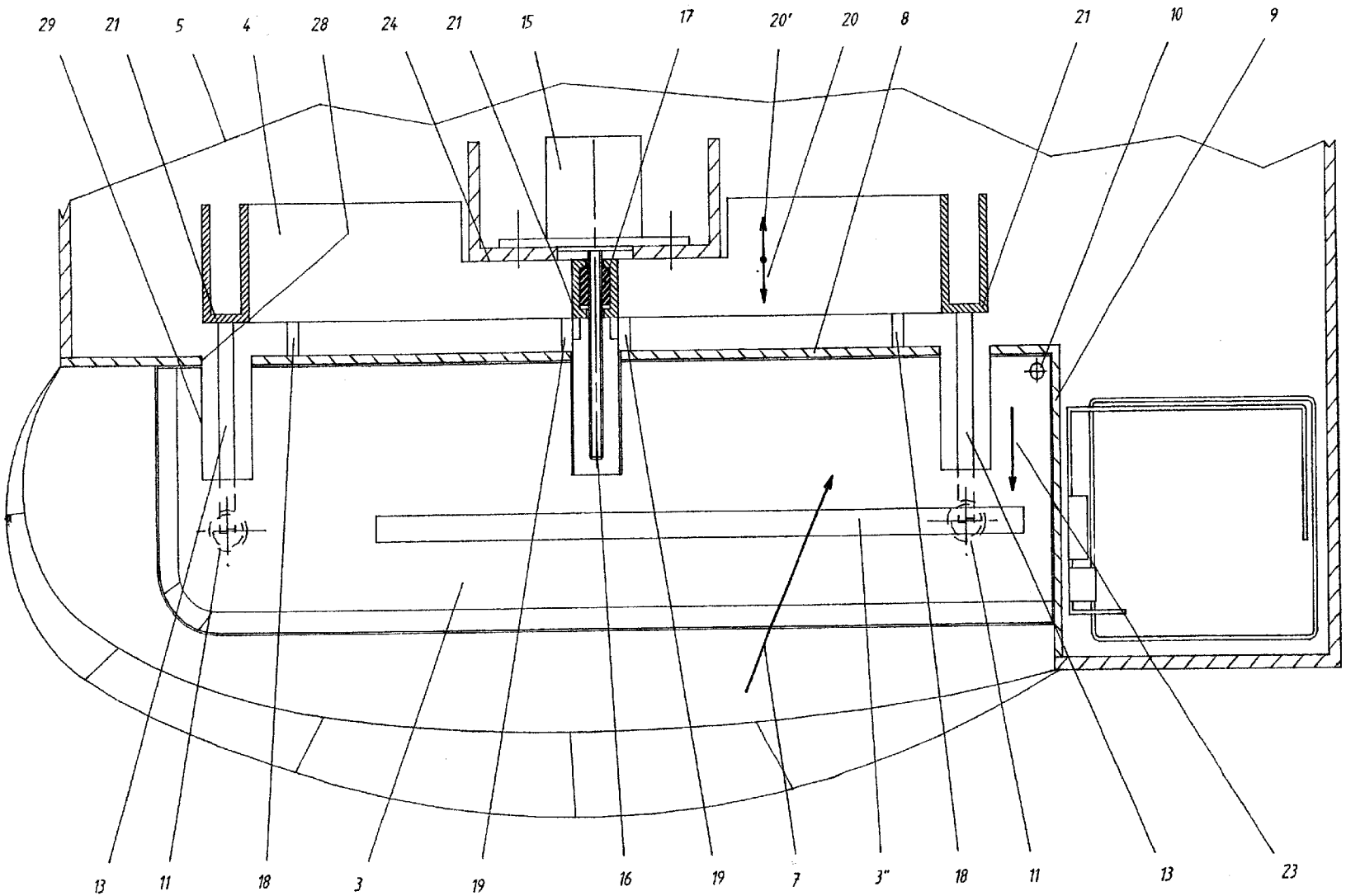
FIG. 2 is a partial top view of the same device of the invention, specifically showing the movement and compensation mechanisms (the printing system and the ceiling have been removed in order to improve the readability of the drawing)
Figure 3:
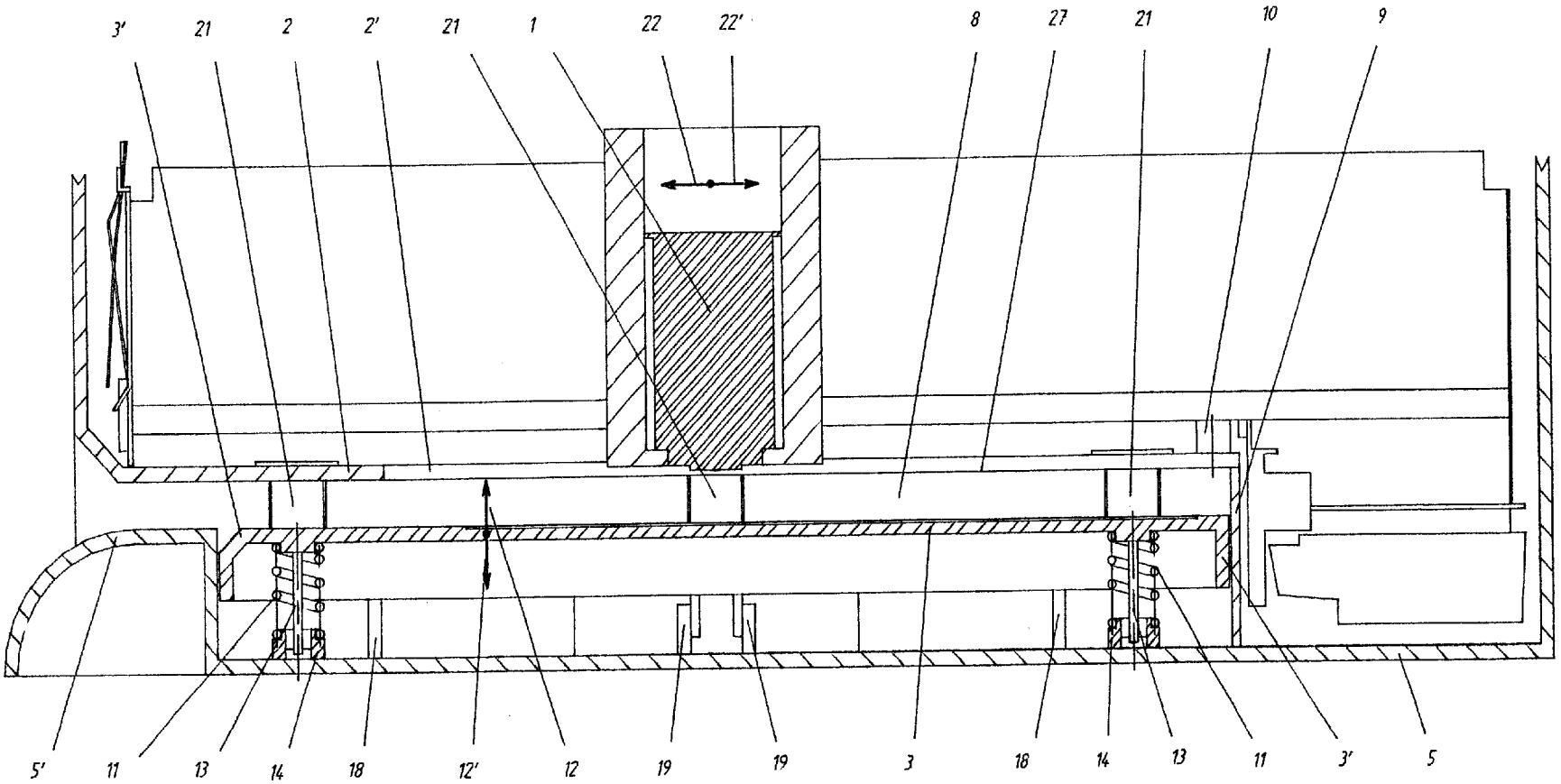
FIG. 3 is a sectional front view of the same device of the invention, specifically showing the printing mechanisms and the movement system according to the invention.
Figure 5:
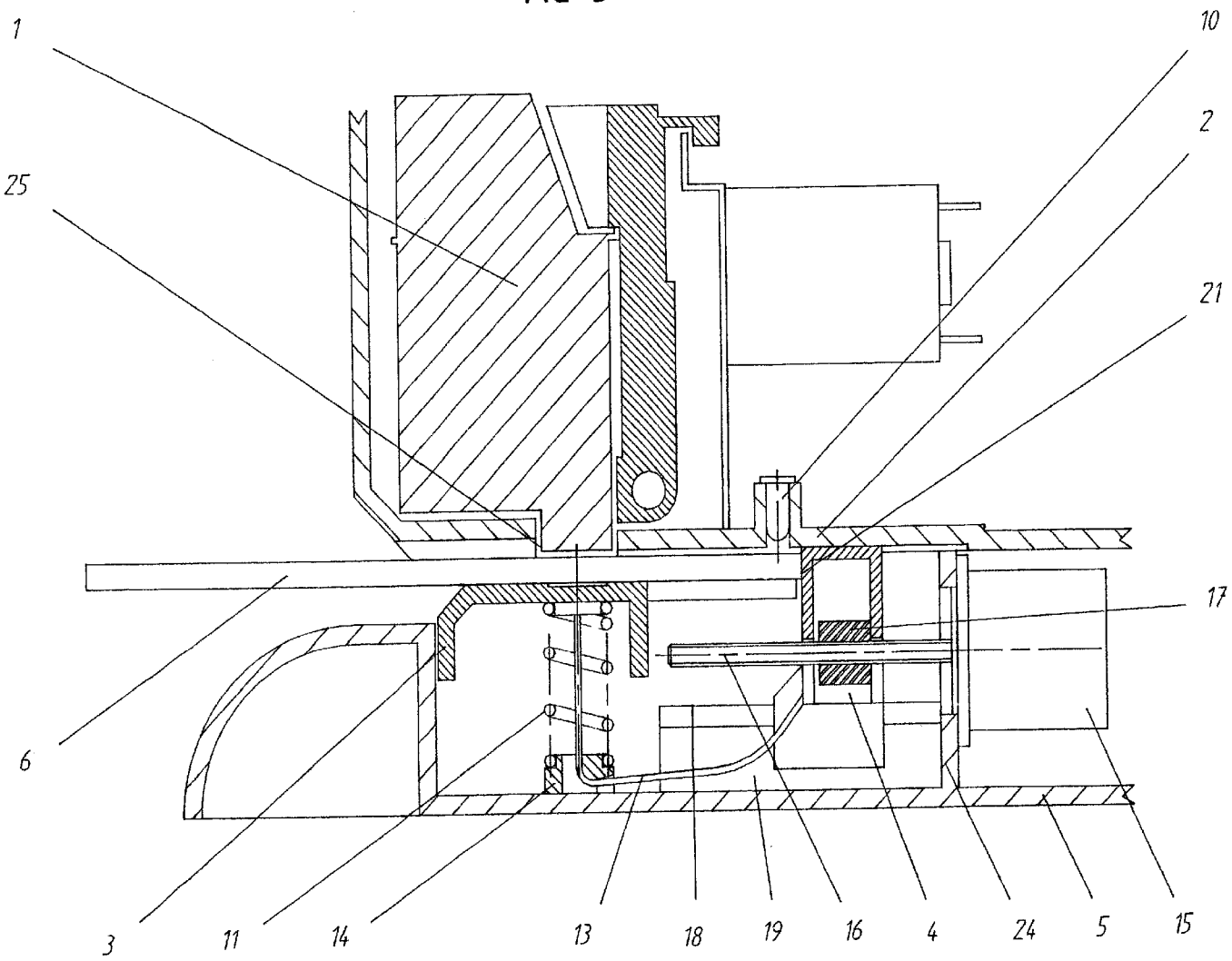
FIGS. 5 and 6 are simplified illustrations similar to FIG. 1, showing the various mechanisms during the two phases of movement of the elements prior to printing.

In the first phase of the forward movement of the movable rake 4 in the direction 20, the lower plate 3, which was in the lower retracted position at the end of the preceding cycle, lifts in the direction 12 under the combined action of the springs 11 and the freedom given to it by the ties 13 as the rake 4 moves forward, and presses the top side of the envelope 6 against the reference surface of the upper ceiling 2. Once the envelope 6 has been pressed into place, the ties 13 slacken. The teeth 21, which were initially behind the reference surface 8 (FIG. 2) then reach the level of said reference surface 8 as represented in FIGS. 4 and 5.

Figure 6:
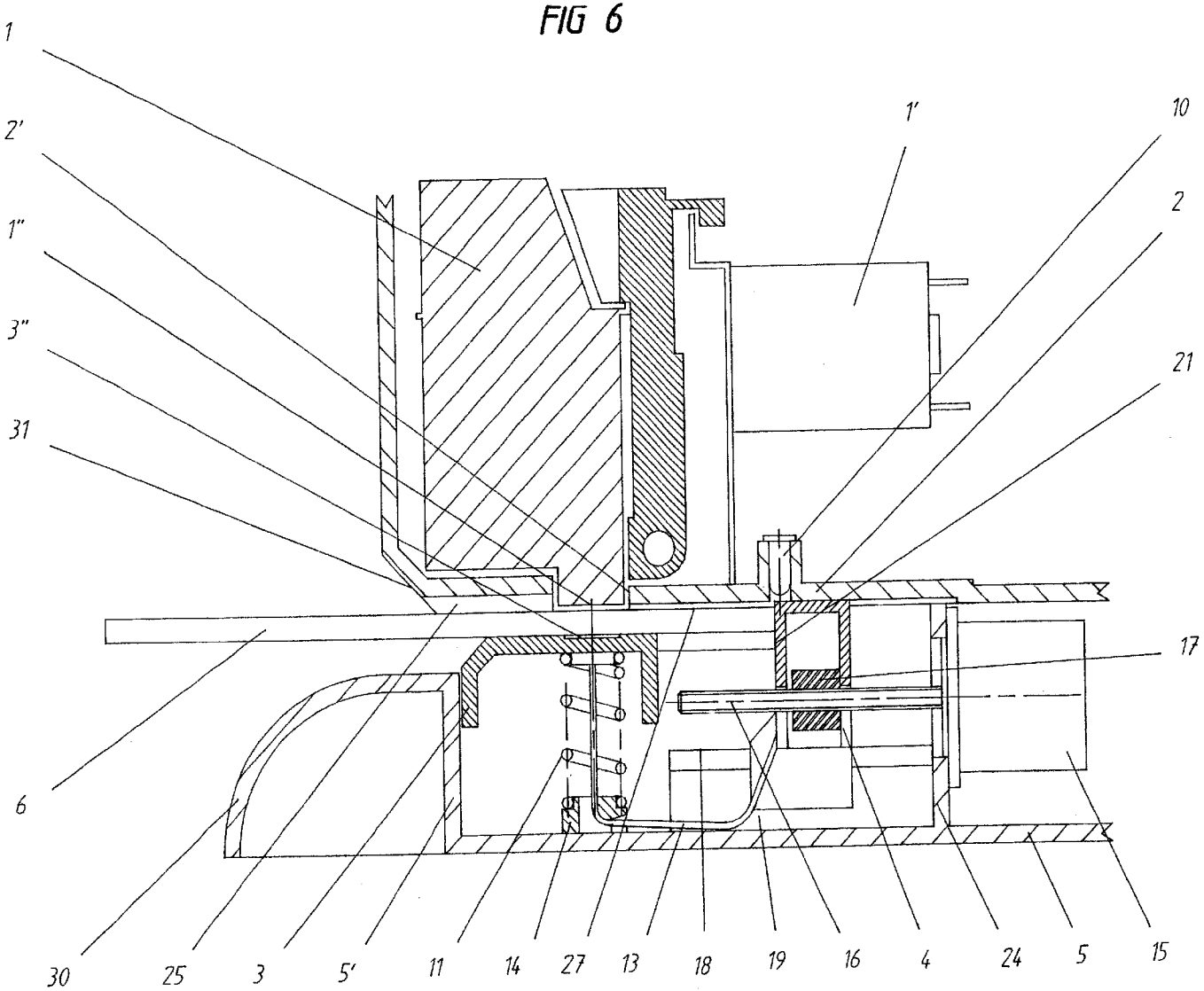

During the second phase of the forward movement of the movable rake 4 in the direction 20, the teeth 21 pass the rear surface 8 and, passing through the notches 29 of the plate 3, push the gripped envelope 6, causing it to slide between the reference surfaces 27 of the. upper ceiling 2 and the lower plate 3 and along the lateral reference surface 9. If an envelope 6 has been positioned incorrectly, as illustrated by envelope 6' indicated by broken lines in FIG. 4, but closely enough to allow it to be detected by the barrier 10, this second phase makes it possible to position the top edge of the envelope exactly perpendicular to the direction of movement 20 as indicated by envelope 6. The envelope 6 and the machine are then in the initial printing position, as illustrated in FIG. 6.

The printing of the mark is obtained through an alternating combination of the usual movements for displacing the ink standard ink jet head 1 and the envelope 6. The ink jet print head prints in the longitudinal direction 22. At the end of the first printing pass and during the return of the print head in the opposite direction 22', the envelope 6 is pushed in the transverse direction 23 by the teeth 21, as a result of the transmission of the rotational movement of the motor 15 to the rake in the direction 20 (identical to the direction 23). The number of passes to be completed in order to print the entire postage mark is a function of the ratio of the width of the postage mark to the printing width of the ink jet head. It is, for example, 6 if the postage mark is one inch (25.4 mm) wide and the head covers one-sixth of an inch (4.23 mm), as usual.

In order not to create waves at the level of the top side of the envelope 6 onto which the postage mark is printed, the reference surface of the upper ceiling 2 is absent in the area 25, which corresponds to the post-print drying area for the ink deposited by the print head 1 in the preceding pass.

After printing, the movable rake 4 moves backward in the direction 20' as far as a fixed stop 24. During its travel, the movable rake 4 stretches the flexible ties 13, and lowers the lower plate 3 in the direction 12'. The envelope 6 is released and can be manually removed.

A suitable electronic control device controls and synchronizes the various mechanisms for performing the above-mentioned cycles.

What is claimed is:

1. A machine for postage metering a flat object comprising:

a drive mechanism;

a frame having a horizontal opening for inserting an object in a longitudinal direction, the frame also having two stops situated at right angles to the longitudinal direction, a fixed upper ceiling having a window, and a lower plate vertically moveable by the drive mechanism;

a device for holding the object by gripping the object between the upper ceiling and the lower plate;

an ink jet printing device having nozzles disposed inside the window of the ceiling;

a sensor for detecting presence of the object in vicinity of a corner of the stops;

an electronic control device, responsive to the sensor, for starting the drive mechanism to move the plate for gripping the object and for starting a print cycle; and a device for moving the object in a direction transverse to the longitudinal direction and while the object is being gripped, in front of the printing device.

2. The machine according to claim 1 wherein the moving device comprises a horizontally moveable rake having teeth that pass one of said stops so as to transversely push an edge of the object.

3. The machine according to claim 2 further comprising a motor for driving the rake.

4. The machine according to claim 3 further comprising a screw-nut system through which the rake is driven by the motor.

5. The machine according to claim 3 wherein the drive mechanism comprises said motor for moving the plate in one direction and springs for moving the plate in another direction.

6. The machine according to claim 5 wherein the movement of the plate is produced by means of movement of the rake.

7. The machine according to claim 6 further comprising at least one flexible tie which links the plate and the rake.

8.The machine according to claim 4 wherein the drive mechanism comprises said motor for moving the plate in one direction and springs for moving the plate in another direction.

9. The machine according to claim 8 wherein the movement of the plate is produced by means of movement of the rake.

10. The machine according to claim 9 further comprising at least one flexible tie which links the plate and the rake.

* * * * *